US005388596A

United States Patent [19]

Schneider et al.

[11] Patent Number: 5,388,596

[45] Date of Patent: * Feb. 14, 1995

[54] COAXIAL CIGARETTE

[75] Inventors: Werner Schneider, Quickborn; Erhard Rittershaus, Hamburg; Erwin Kausch, Jesteburg-Itzenbüttel; Horst Borowski, Hamburg; Bernd-Henrik Müller, Hamburg; Gert Rudolph, Hamburg; Adolf Schlüter, Quickborn; Wolfgang Trinkies, Wedel; Wolfgang Wiethaup, Hamburg, all of Germany

[73] Assignee: B.A.T. Cigarettenfabriken GmbH, Hamburg, Germany

[ * ] Notice: The portion of the term of this patent subsequent to Jan. 10, 2012 has been disclaimed.

[21] Appl. No.: 845,667

[22] Filed: Mar. 4, 1992

[30] Foreign Application Priority Data

Mar. 8, 1991 [DE] Germany ..... 4107522

[51] Int. Cl.[6] ..... A24D 1/00

[52] U.S. Cl. ..... 131/360; 131/194; 131/338

[58] Field of Search ..... 131/360, 194, 202, 331, 131/338

[56] References Cited

U.S. PATENT DOCUMENTS

| | | | |
|---|---|---|---|
| 3,260,265 | 7/1966 | Oster . | |
| 3,356,094 | 12/1967 | Ellis et al. . | |
| 3,612,066 | 10/1971 | Jones et al. | 131/298 |
| 3,614,956 | 10/1971 | Thornton . | |
| 4,219,031 | 8/1980 | Rainer et al. . | |
| 4,920,990 | 5/1990 | Lawrence et al. | 131/360 X |
| 4,986,287 | 1/1991 | Schneider et al. | 131/360 |
| 5,025,812 | 6/1991 | Fagg et al. | 131/298 X |

FOREIGN PATENT DOCUMENTS

| | | |
|---|---|---|
| 998556 | 1/1952 | France . |
| 1322254 | 2/1963 | France . |
| 3602846 | 8/1986 | Germany . |
| 3743597 | 2/1989 | Germany . |
| 4020496 | 1/1991 | Germany . |
| 1086443 | 10/1967 | United Kingdom . |
| 2070409 | 9/1981 | United Kingdom . |

*Primary Examiner*—Jennifer Bahr

*Attorney, Agent, or Firm*—Armstrong, Westerman, Hattori, McLeland & Naughton

[57] ABSTRACT

The invention relates to a coaxial cigarette comprising a coaxial tobacco rod of a core and a rod periphery which contain different mixtures, the sheaths of the rod core and the rod periphery consisting of combustible material and a filter mouthpiece being provided at one end of the coaxial tobacco rod; according to the invention, the ratio of the draw resistance of the core per unit length to the packing density thereof lies in the range from about 0.13 to about 0.27 mm WC $cm^2/mg$ whilst the ratio of the draw resistance per unit length of the rod periphery to the packing density thereof lies in the range of about 0.07 to about 0.11 mm WC $cm^2/mg$; the filter mouthpiece is a conventional preferably ventilated filter.

8 Claims, 1 Drawing Sheet

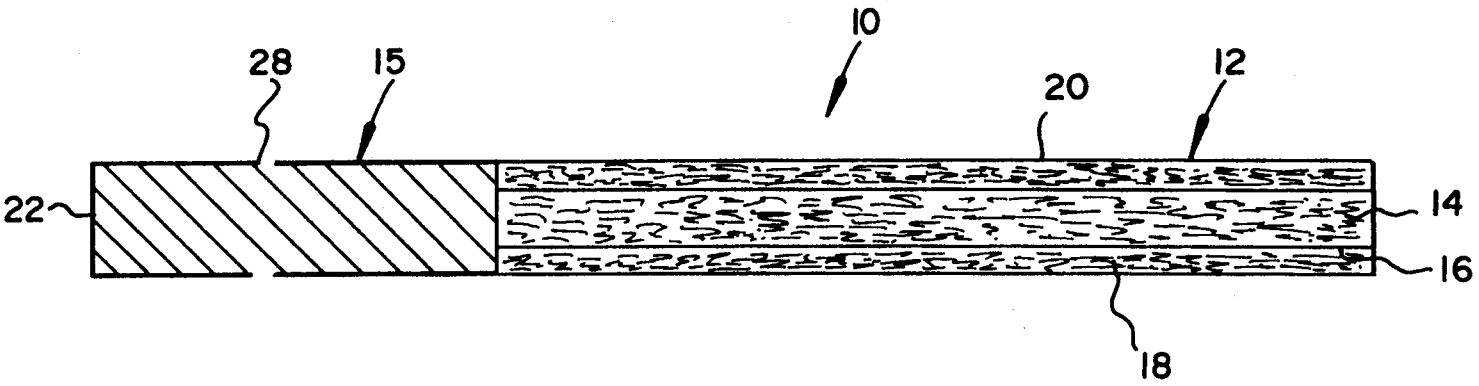
10
12
14
16
18
20
15
28
22

COAXIAL CIGARETTE

BACKGROUND OF THE INVENTION

1. Field of the Invention

The invention relates to a coaxial cigarette comprising a coaxial rod, the core of the rod consisting of a different mixture of a material smouldering substantially without residue, in particular tobacco material, than the periphery of the rod, a sheath of the rod core of cigarette paper or tobacco sheet, a sheath of the rod periphery of cigarette paper or tobacco sheet, and a filter mouthpiece.

2. Description of the Prior Art

In various publications socalled "coaxial smokable articles" have been described. As a rule, these coaxial smokable articles are coaxial cigars or cigarettes having an inner core which is surrounded by a jacket of tobacco material. Such a coaxial cigarette was mentioned for example in FR-PS 998,556. The inner core thereof consisted of a tobacco of relatively low quality and the jacket thereof of a higher quality tobacco. This made it possible to achieve savings with regard to the tobacco material required.

Further prior publications also disclose such coaxial cigarettes, for example FR-PS 1,322,254, U.S. Pat. Nos. 3,614,956, 4,219,031, GB-OS 2,070,409 and GB-PS 1,086,443. A relatively highly developed coaxial cigarette is described in DE-OS 3,602,846. This however does not have any filter which could trap the undesirable smoke constituents.

In the coaxial cigarette according to U.S. Pat. No. 3,356,094 an inner hollow tube and an aerosol chamber having a narrow outlet are provided. However, this type of coaxial cigarette is practically not usable because it can be made only by employing a very expensive method and in addition due to the various constituents separate from each other it has an unusual smoke pattern which is characteristic of said constituents.

From DE 40 20 496 A1 a coaxial cigarette is known which is surrounded by a metallic foil sheath. The space containing the tobacco thereby formed is surrounded by a hollow cylinder of carbon combustible material which is surrounded by an air-permeable sheath. Finally, the known cigarette has a filter at one end.

If the known cigarette according to DE 40 20 496 A1 had a draw resistance of 10 mm WC/cm tobacco rod, by conversion therefrom 0.10 to 0.33 mm WC $cm^2/mg$ would result for the core.

This configuration leads both to an increase in costs and to a complication of the manufacture of this known coaxial cigarette and at the same time the acceptance of this product by the consumer decreases because both an unusual smoke pattern and a reduced smoking experience when smoking this coaxial cigarette result.

The coaxial cigarette of this type according to DE-PS 3,743,597 is additionally provided with a ventilated coaxial filter having a filter core, the inner diameter of which corresponds substantially to the diameter of the inner core of the coaxial cigarette and which has a filter jacket. In addition, the filter core has an air-impermeable sheath. The filter jacket has an air-permeable sheath. The sheath of the inner core of the coaxial cigarette and the sheath of the outer jacket thereof are provided with glow salts, the draw resistance of the inner core being lower than the draw resistance of the outer jacket of the coaxial cigarette. This known coaxial cigarette has the advantage that undesirable combustion products are retained to a large extent in the coaxial filter.

A disadvantage of the coaxial cigarette of this type is however that the production thereof is relatively complicated and expensive.

SUMMARY OF THE INVENTION

The object of the invention is therefore to overcome the disadvantages of the known prior art. In particular, the object of the invention is to provide a coaxial cigarette of the type referred to which firstly can be made more economically and secondly permits a favourable ratio of desired nicotine and aroma constituents with simultaneous reduction of undesired gas phase constituents in the main smoke.

The invention therefore proposes in a coaxial cigarette comprising a coaxial rod, the core of the rod consisting of a different mixture of a material smouldering substantially without residue, in particular tobacco material, than the periphery of the rod, a sheath of the rod core of cigarette paper or tobacco sheet, a sheath of the rod periphery of cigarette paper or tobacco sheet, and a filter mouthpiece, the improvement in which the ratio of the draw resistance of the core per unit length to the packing density thereof lies in the range of about 0.13 to about 0.27 mm WC $cm^2/mg$ (measured with air-impermeable sheath and a flow rate of 17.5 ml/s); the ratio of the draw resistance of the periphery per unit length to the packing density thereof lies in the range of about 0.07 to about 0.11 mm WC $cm^2/mg$ (measured with air-impermeable sheath on the inside and outside, an impermeable core and a flow rate of 17.5 ml/s); the filter mouthpiece is a conventional filter, preferably of the ventilated type; and the nicotine content of the mixture of the core is greater than 3% by weight and the nicotine content of the mixture of the periphery of the rod is less than 1.1% by weight.

Expedient further developments will be apparent from the features in the subsidiary claims.

In an extremely surprising manner it has been found that undesired smoke constituents can be retained in a coaxial cigarette even if a conventional filter is used, i.e. not a coaxial filter. It is necessary here for the ratio of the draw resistance per unit length of the core of the coaxial tobacco rod to the packing density thereof to lie in the range of about 0.13 to about 0.27 mm WC $cm^2/mg$ whilst the ratio of the draw resistance per unit length of the rod periphery of the coaxial tobacco rod to the packing density thereof lies in the range from about 0.07 to about 0.11 mm WC $cm^2/mg$.

The ratios of the draw resistances per unit length to the respective packing density were measured for an air-impermeable sheath for the core and an air-impermeable inner and outer sheath and impermeable core for the rod periphery and a flow rate of 17.5 ml/s.

With the aid of the coaxial cigarette according to the invention it is possible in spite of filter ventilation to obtain a pronounced increase of the quotient "condensate yield/nicotine yield per cigarette" (abbreviation: C/N) without having to use a coaxial filter type to do this. This means that the full smoking enjoyment is available to the consumer whilst at the same time undesirable gaseous smoke constituents are reduced by filter ventilation. At the same time the coaxial cigarette according to the invention can be made without great technical expenditure and without using special materials and is consequently more economical. Thus, the consumers have at their disposal an alternative to the conventional cigarette which is not only theoretical.

The positive effects can be intensified according to the invention if the conventional filter used is ventilated, i.e. provided with small openings or perforations.

With a mixture-nicotine content according to the invention of more than about 3% in the peripheral region of the coaxial rod in a cigarette as claimed, the C/N value of the cigarette is considerably greater than the C/N value of the filterless cigarette, in spite of ventilation degrees of up to 80%. At the same time, for the tobacco mixture in the core the mixture-nicotine content is less than 1.1%. The specified degree of ventilation up to about 80% represents the ventilation degree of the conventional filter used according to the invention.

The condensate yield relates to the nicotine-free dry condensate measured according to DIN. The nicotine yield is likewise determined by the known standard provisions.

For a coaxial cigarette according to the invention having a C/N value corresponding approximately to the C/N value of a filterless cigarette, a mixture nicotine content results in the rod core of more than 3% and a mixture nicotine content in the rod periphery of less than 1.1%.

As filter, any commercially available filter or other filter known in the art can be employed. It should be ensured in particular that the draw resistance of the filter used is greater than 15 mm water column (mm WC), measured closed.

A ventilation zone advantageously provided in the filter used should permit ventilation degrees in the range from about 40 to about 80% for a given draw resistance of the coaxial rod.

It is particularly expedient to use a cellulose acetate filter having a draw resistance between 40 and 80 mm WC and/or a ventilation degree between 40 and 80%. The effects achieved are the stronger the higher the ventilation degree of the filter.

As a rule, the coaxial cigarette according to the invention has a coaxial tobacco rod with a total diameter between about 7 and 9 mm. The rod core has a diameter between 3 and 6 mm, diameters between 4.5 and 5.5 mm being preferred.

The air permeability of the sheath of the rod core, i.e. the inner sheath of the coaxial rod consisting usually of cigarette paper or tobacco sheet, is preferably less than 25 ISO units. The outer sheath of the tobacco rod, consisting generally of cigarette paper or tobacco sheet, preferably has an air permeability lying between 25 and 50 ISO units.

By way of example two filterless coaxial rods having a C/N value of 7.2 (case A) and 8.6 (case B) will be assumed. On said rods identical ventilated filters are placed which have a ventilation degree of about 75% and a draw resistance of 70 mm WC, measured closed.

If a conventional normal rod were used this ventilation degree and the dilution of the smoke resulting therefrom would lead to a pronounced reduction of the C/N value. In this connection attention is drawn to the article "Contributions to tobacco research", volume 7, no. 5, September 1974, pages 282 et seq., by V. Norman. This reduction lies for the present ventilation degrees for example in a range from 30 to 40%, i.e. should lead to a C/N value of about 4 (case A) and 5 (case B).

However, with a coaxial cigarette according to the present invention the following values are obtained for the two cases to be distinguished here (A, B):

Case A: With a ratio of the draw resistance to the packing density for the core of the coaxial rod of 0.23 and for the jacket of 0.08 the C/N value is 7.3, the mixture nicotine content in the core being 0.9% and in the jacket 4.5%.

Case B: With a ratio of the draw resistance to the packing density in the core of 0.17 and in the jacket of 0.09 the resulting C/N value is 13.3, the content of the mixture nicotine in the core being 4.5% and in the jacket 0.9%.

These values show in impressive manner the advantages of the coaxial cigarette according to the invention, i.e. a favourable ratio of desired nicotine and aroma constituents with simultaneous reduction of undesirable gas phase constituents by ventilation, combined with the desired full flavour impression. The present invention has excellent practicability offering the consumer a real alternative to conventional cigarettes.

BRIEF DESCRIPTION OF THE DRAWING

The coaxial cigarette according to the present invention will be explained hereinafter with the aid of the attached Figure showing a longitudinal section through the coaxial cigarette. Further advantages and features of the present invention will be disclosed.

DESCRIPTION OF THE PREFERRED EMBODIMENT

The coaxial cigarette 10 according to the invention comprises a coaxial tobacco rod which is followed by a conventional commercially usual filter 15. The filter 15 is provided with ventilation openings 28. These ventilation openings are advantageously in a filter covering paper which is not explicitly illustrated and which at the same time serves to secure the filter to the tobacco rod. The filter sheath paper covered by the filter cover is air-permeable or perforated like the cover paper. At the end 22 of the filter there is the draw opening at which the consumer draws or inspires in order to enjoy the ingredients of the burning tobacco.

The coaxial tobacco rod 12 consists of a core 14 and a periphery or jacket 18. The core 14 is provided with a sheath 16 consisting generally of cigarette paper or tobacco sheet. The periphery 18 is also surrounded by a sheath 20 likewise consisting of cigarette paper or tobacco sheet.

According to the invention the core 14 of the coaxial rod 12 and the periphery 18 of the coaxial rod 12 have different ratios of the draw resistance per unit length to the packing density. Thus, for the core 14 this ratio lies between about 0.13 and about 0.27 mm WC $cm^2/mg$. This ratio lies for the periphery 18 of the tobacco rod 12 between about 0.07 and about 0.11 mm WC $cm^2/mg$. With these different values in combination with certain nicotine contents of the mixtures in the core and periphery, it is possible to prevent a reduction of the quotient C/N in spite of filter ventilation so that said quotient can even be increased compared with filterless cigarettes. This may be desirable for reasons of flavour, reducing at the same time undesirable gas phase constituents in the main smoke by ventilation.

The diameter of the coaxial cigarette 10 according to the invention lies as a rule between 7 and 9 mm, values between 7.2 and 8 mm being preferred. The rod core 14 has a diameter between 3 and 6 mm, preferably between 4.5 and 5.5 mm.

The air permeability of the sheath 16 of the rod core is less than 25 ISO units whilst the air permeability of the sheath 20 of the jacket 18 lies between about 25 and about 59 ISO units.

The filter 15 has a draw resistance greater than about 15 mm WC. The ventilation preferably achieved via several ventilation openings 28 lies in the range of about 40 to 80%. Particularly recommendable is a cellulose acetate filter having a draw resistance between 40 and 80 mm water column (measured closed) and a ventilation degree between about 40 and about 80%.

With a coaxial cigarette 10 according to the present invention for the two cases (A, B) to be distinguished the following values were obtained, the quotient C/N corresponding in case A approximately to that of the filterless cigarette whilst being considerably greater in case B.

Case A: With a ratio of the draw resistance to the packing density for the core 14 of the coaxial rod 20 of 0.23 and for the jacket 18 of 0.08 the C/N value was 7.3, with a mixture nicotine content in the core 14 of 0.9% and with a mixture nicotine content in the jacket 18 of 4.5%.

Case B: With a ratio of the draw resistance to the packing density in the core 14 of 0.17 and in the jacket 18 of 0.09 a C/N value of 13.3 was obtained with a mixture nicotine content 14 of 4.5% and in the jacket 18 of 0.9%.

A filterless coaxial rod 12 having a C/N value of 7.2 (case A) and 8.6 (case B) was used to which was attached a ventilated filter 15 having a ventilation degree of about 75% and a draw resistance of 70 mm WC (measured closed).

Thus, compared with the C/N of the coaxial rod without filter in the case A practically no change (C/N=7.3) results whereas in case B a clear increase is observed (C/N=13.3 compared with C/N=8.6 for the filterless coaxial rod). In both cases the filter ventilation leads to an overproportional reduction of undesirable gas phase constituents in the main smoke, as is described in the cited literature.

We claim:

1. A coaxial cigarette comprising:

a) a coaxial rod, a core of the rod and a periphery of the rod each having a different mixture of a material for smouldering substantially without residue, b) a sheath of the rod core of cigarette paper or tobacco sheet, c) a sheath of the rod periphery of cigarette paper or tobacco sheet, and d) a filter mouthpiece, wherein e) a ratio of the draw resistance of the core per unit length to the packing density thereof lies in the range of about 0.13 to about 0.27 mm WC $cm^2/mg$ measured with air-impermeable sheath and a flow rate of 17.5 ml/s;

f) a ratio of the draw resistance of the periphery per unit length to the packing density thereof lies in the range of about 0.07 to about 0.11 mm WC $cm^2/mg$ measured with air-impermeable sheath on the inside and outside, an impermeable core and a flow rate of 17.5 ml/s;

g) the filter mouthpiece is a non-coaxial filter; and h) a nicotine content of the mixture of the core is greater than 3% by weight and a nicotine content of the mixture of the periphery of the rod is less than 1.1% by weight.

2. A coaxial cigarette according to claim 1, wherein the filter has a draw resistance greater than 15 mm WC.

3. A coaxial cigarette according to claim 1, wherein the filter is provided with a ventilation zone.

4. A coaxial cigarette according to claim 1, wherein the filter is provided with a ventilation zone which for a given draw resistance of the coaxial rod has a ventilation degree in the range of about 40 to 80%.

5. A coaxial cigarette according to claim 1, wherein the filter is a cellulose acetate filter which has a draw resistance between 40 and 80 mm WC and/or a ventilation degree between about 40 and 80%.

6. The coaxial cigarette of claim 1, wherein the filter is a ventilated type filter.

7. A coaxial cigarette comprising:

a) a coaxial rod, a core of the rod and a periphery of the rod each having a different mixture of a material for smouldering substantially without residue, b) a sheath of the rod core of cigarette paper or tobacco sheet, c) a sheath of the rod periphery of cigarette paper or tobacco sheet, and d) a filter mouthpiece, wherein e) a ratio of the draw resistance of the core per unit length to the packing density thereof lies in the range of about 0.13 to about 0.27 mm WC $cm^2/mg$ measured with air-impermeable sheath and a flow rate of 17.5 ml/s;

f) a ratio of the draw resistance of the periphery per unit length to the packing density thereof lies in the range of about 0.07 to about 0.11 mm WC $cm^2/mg$ measured with air-impermeable sheath on the inside and outside, an impermeable core and a flow rate of 17.5 ml/s;

g) the filter mouthpiece is a non-coaxial filter; and h) a nicotine content of the mixture of the core is less than 1.1% by weight and the nicotine content of the mixture of the periphery of the rod is greater than 3% by weight.

8. The coaxial cigarette of claim 7, wherein the filter is a ventilated type filter.

* * * * *